United States Patent [19]

Karr et al.

[11] 4,445,646

[45] May 1, 1984

[54] APPARATUS AND METHOD FOR STARTING SUCCESSIVE LEADING ENDS ON TRAVELLING WEB IN A WINDER

[75] Inventors: Gerald W. Karr, South Beloit; George H. Wong, Roscoe, both of Ill.

[73] Assignee: Beloit Corporation, Beloit, Wis.

[21] Appl. No.: 355,215

[22] Filed: Mar. 5, 1982

[51] Int. Cl.[3] ..... B65H 19/20

[52] U.S. Cl. ..... 242/56 R

[58] Field of Search ..... 242/56 R, 56 A, 56.2, 242/56.3, 56.6; 83/302, 407, 428, 926 H, 610, 612; 156/525, 510, 512; 408/186, 187

[56] References Cited

U.S. PATENT DOCUMENTS

| | | | |
|---|---|---|---|
| 2,176,198 | 10/1939 | Berry | 242/65 |
| 3,276,303 | 10/1966 | Tompos | 83/428 |
| 3,586,253 | 6/1971 | Gilbank | 242/65 |
| 3,764,085 | 10/1973 | Hawkins | 242/56.6 |
| 3,857,524 | 12/1974 | Melead et al. | 242/56 |

FOREIGN PATENT DOCUMENTS 721883 11/1978 Fed. Rep. of Germany .

*Primary Examiner*—Leonard D. Christian

*Attorney, Agent, or Firm*—Hill, Van Santen, Steadman & Simpson

[57] ABSTRACT

Apparatus and method for starting respective leading ends on web running continuously and wound into successive rolls. As each roll reaches a final diameter, a fresh leading end is provided on the web by machine direction slitting partial separation of a leading end tongue area and cross machine slitting of the remainder of a fresh leading end on the web, followed by complete separation of a leading end on the tongue area and directing of the tongue area and the remainder of the fresh leading end of the web into winding relation onto a fresh rotary core for winding of the web into another roll. This is adapted to be effected automatically and without interruption of high speed web travel and roll winding.

17 Claims, 13 Drawing Figures

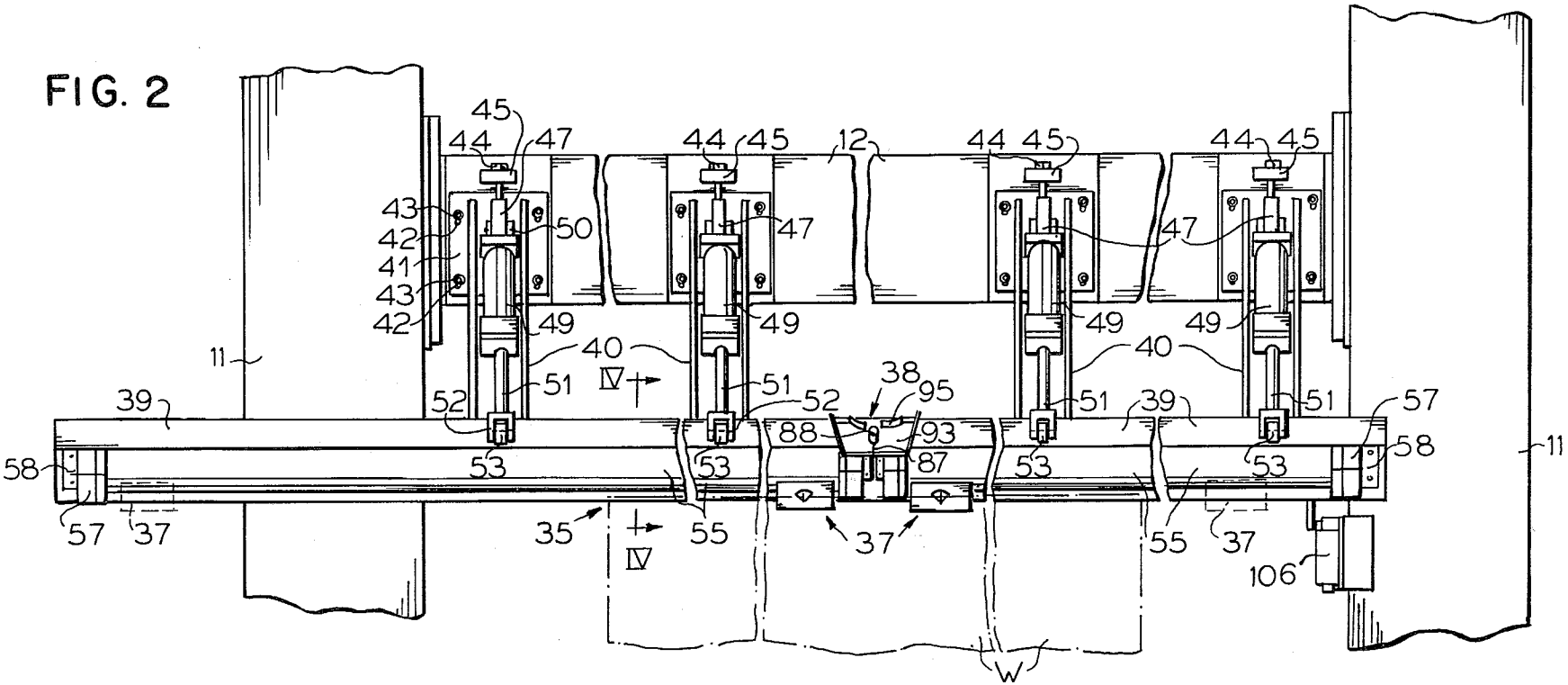
FIG. 2
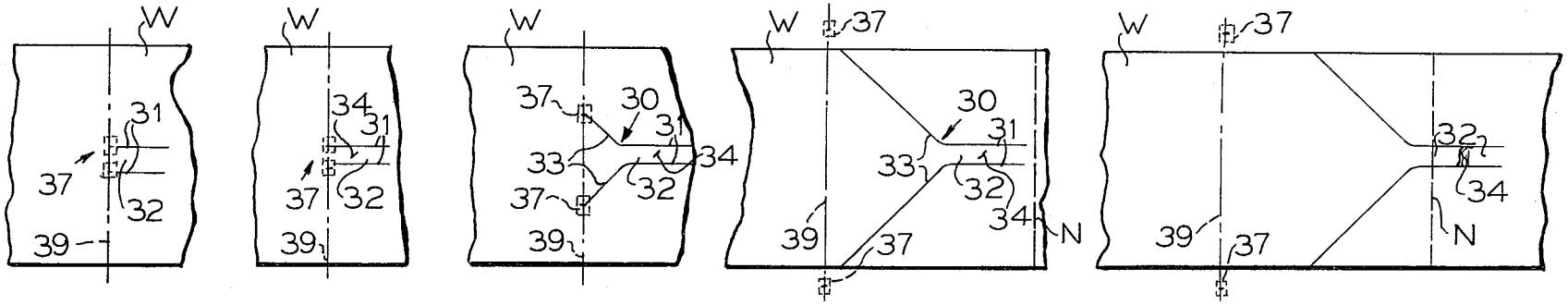

APPARATUS AND METHOD FOR STARTING SUCCESSIVE LEADING ENDS ON TRAVELLING WEB IN A WINDER

This invention relates to new and improved apparatus for winding continuously running web into successive rolls, and a method, and is more particularly concerned with facilitating for each roll to be wound the starting of winding of a respective leading end of the web onto a rotating core which may be in driving nip engagement with a rotary winding drum functioning to continue winding of the web to a desired diameter on the core.

Various expedients have heretofore been employed for starting or turning up a leading end of a continuously running web onto a shaft, reel, spool or (more generically) core driven rotatably by engagement with a winding drum functioning to continue winding of the web onto the core until a roll of desired diameter has been achieved.

Fairly sophisticated winders have been developed for this purpose. By way of example, prior U.S. Pat. No. 2,176,198 is referred to as an early version of such winders and such patent suggests that after a roll of paper web has been fully wound, the web is severed by a conventional air slice and directed around a new core.

U.S. Pat. No. 3,586,253 shows a later development and is particularly referred to for its showing of a supplying successive empty, fresh cores to a winder drum of the winder apparatus.

U.S. Pat. No. 3,857,524 discloses a particular arrangement of combination cut-off knife and guide for initiating winding of a freshly severed leading end of the web onto a fresh core after a preceeding roll of the web has been fully wound. In this patent, the web is severed entirely across the web by the cut-off knife which extends transversely across the width of the web and is forcibly driven against the tensioned web with a rapid chopping action. A disadvantage of this arrangement is that the combination cut-off and guiding device is necessarily located between the winding drum and an enveloper roll which is required to continue surface winding operation of the filled or fully wound roll after it is shifted away from the winding drum, and the cut-off and guiding device goes into action against the span of the web between the winding roll and the enveloper roll. A long and expensive knife blade is required. Resharpening presents problems.

In another conventional system, a limited length transverse slash has been made in the advancing web upstream from the nip between a fresh core supplied to the winding drum, and then on the downstream side of the nip an air jet directed toward the nip enters the slit and initiates tearing of the web away from the slit thus initiating a fresh leading end which is blown against the rotating core and tears away from the trailing portion of the web finally wound onto the fully wound preceeding roll. This system has been employed with considerable success with lighter grades of paper web, but is impractical for heavier grades of web or sheet due to the higher longitudinal or machine direction strength of the heavier grade webs. Further, in recent years the width of paper webs has increased for economy reasons, and especially in the wider groundwood sheet machines and increasing number of missed turn-ups have been experienced with the slasher and turn-up guide system, principally because the tear often does not progress all the way to the edge of the web.

A principal object of the present invention is to overcome the disadvantages, drawbacks, inefficiencies, shortcomings, and problems inherent in prior expedients for effecting and starting winding of fresh leading ends on continuously running webs in roll winders.

To this end, the present invention provides in apparatus for winding web running continuously in a machine direction into successive rolls, and including means for starting winding of a respective leading end of the web onto a respective fresh rotating core for each roll: slitting means located upstream from said fresh rotating core; means for operating said slitting means, after a preceeding roll has been wound to a desired diameter, for starting a fresh leading end on the continuously running web by first slitting the web a limited distance in the machine direction for defining an elongate leading starter tongue area attached at its ends to the web and then completing the remainder of the fresh leading end by slitting the web in cross machine direction from said tongue area; and said winding starting means being adapted for completing separation of said tongue area from said web and for directing the tongue area and said remainder of said fresh leading end into winding relation onto a fresh rotating core for winding of the web into another roll.

The invention also provides a method of winding into successive rolls a web running continuously in a machine direction, and including, for each roll, starting winding of a respective leading end of the web onto a respective fresh rotating core, comprising: at a location upstream from the fresh rotating core, and after a preceeding roll has reached a desired diameter, starting a fresh leading end on the web including first slitting the continuously running web along a limited machine direction distance and thereby defining an elongate leading end starter tongue area for the fresh leading end; then continuing slitting of the web but in cross machine direction and away from said tongue area to the web edge to complete separation of said fresh leading end from the length of the web wound on the preceeding roll; effecting separation of said tongue area from a leading end attachment of the tongue area to the web; and then directing said tongue area and the remainder of said fresh leading end of the web into winding relation onto the fresh rotary core for winding of the web into another roll.

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure and in which:

FIG. 2 is a fragmental elevational view taken substantially in the plane of line II—II of FIG. 1;

Figure 1:
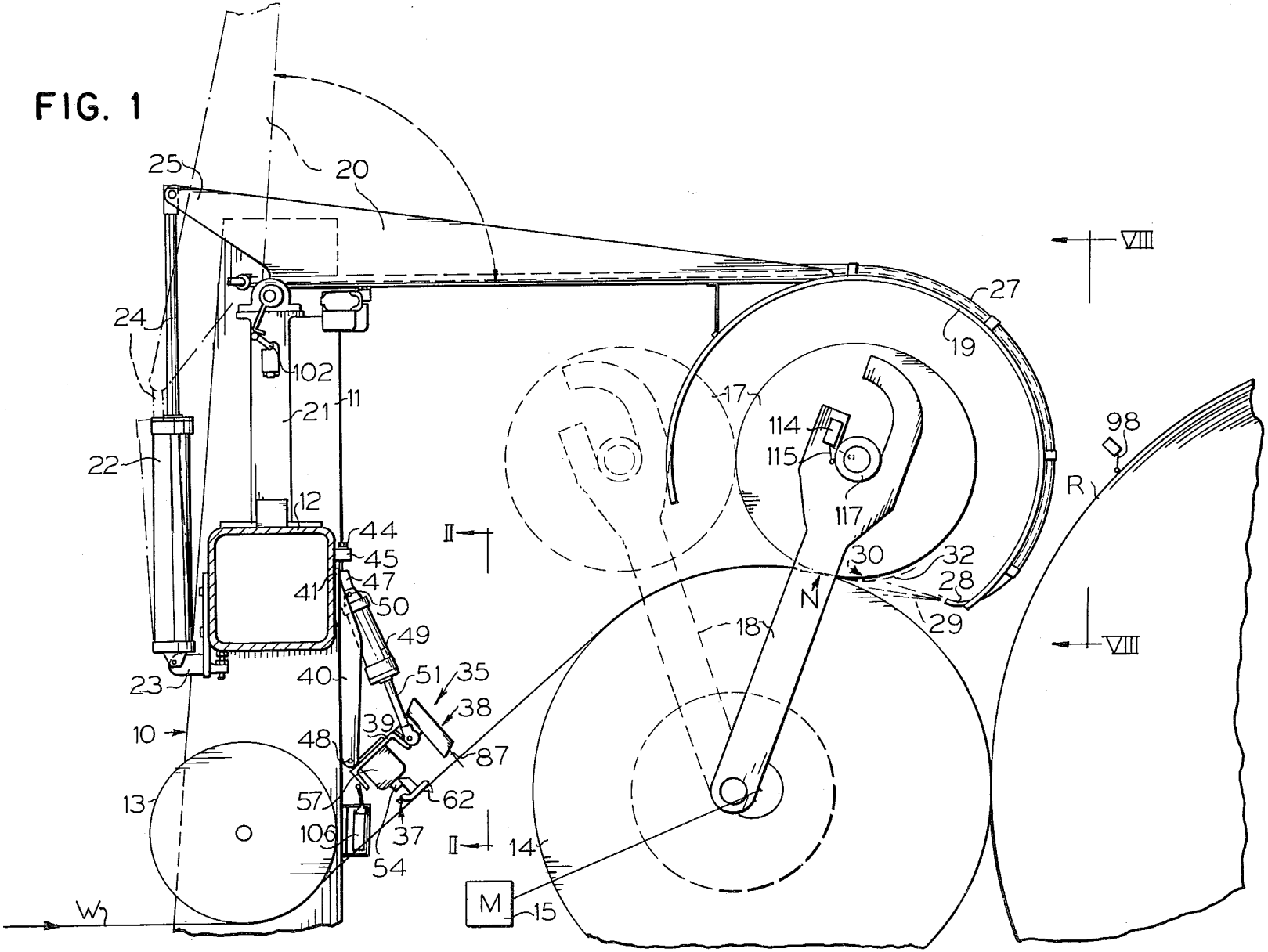
FIG. 1 is a more or less schematic side elevational sectional view showing apparatus embodying the invention.
Figure 4:
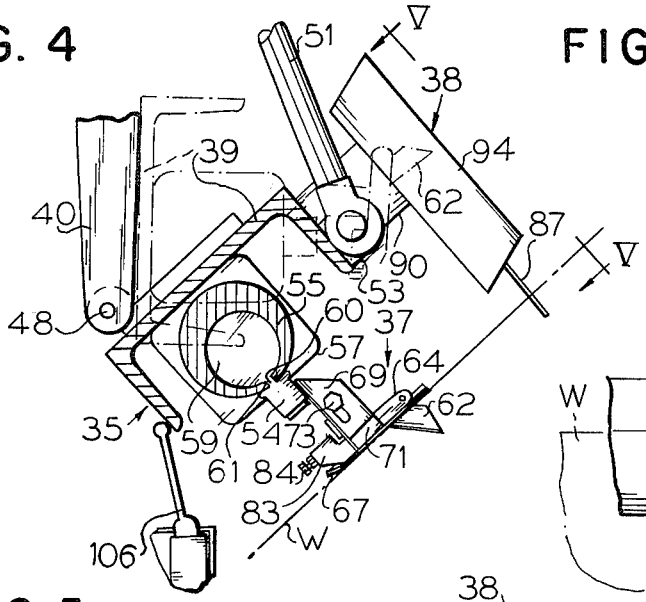
Figure 8:
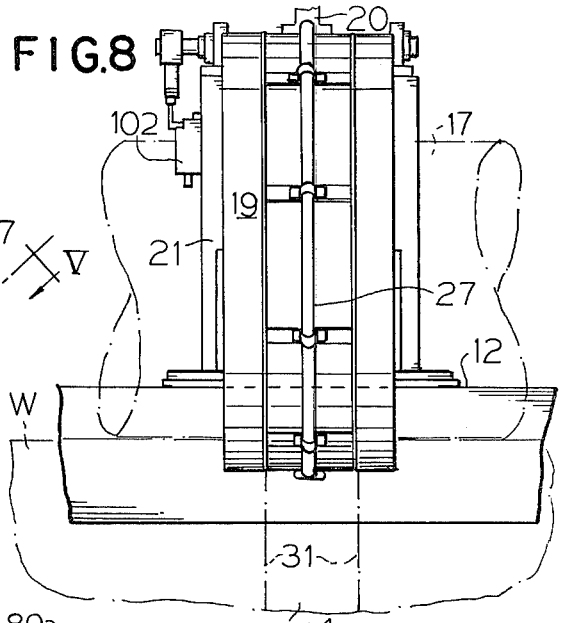
Figure 5:
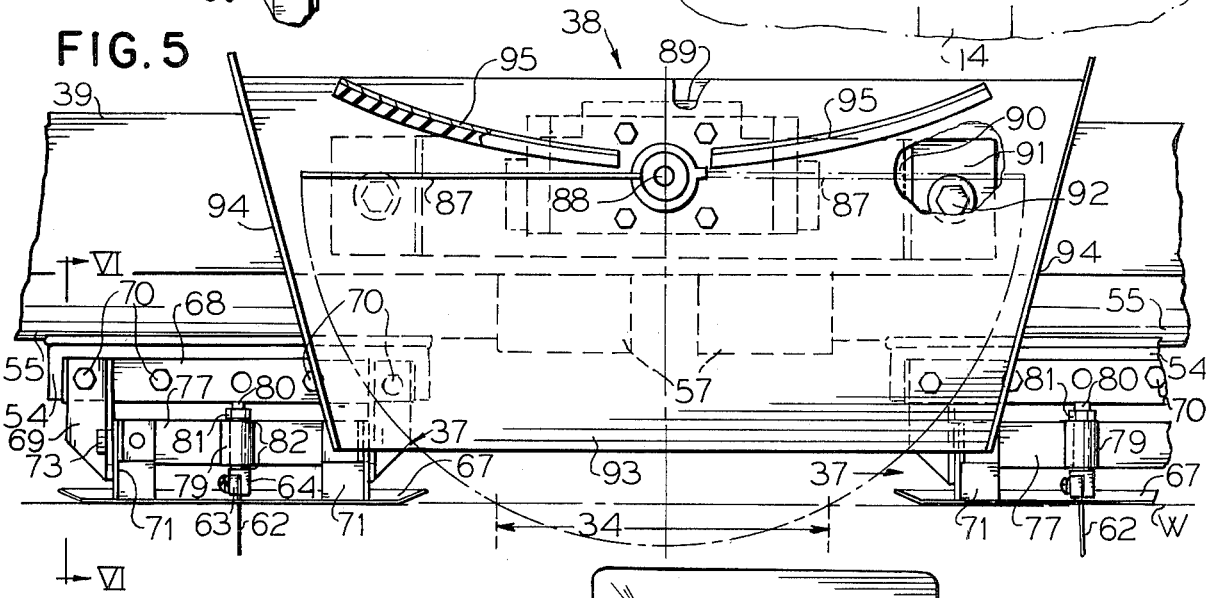
Figure 6:
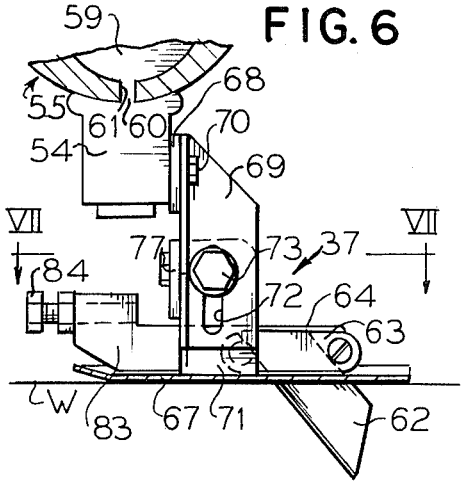
Figure 7:
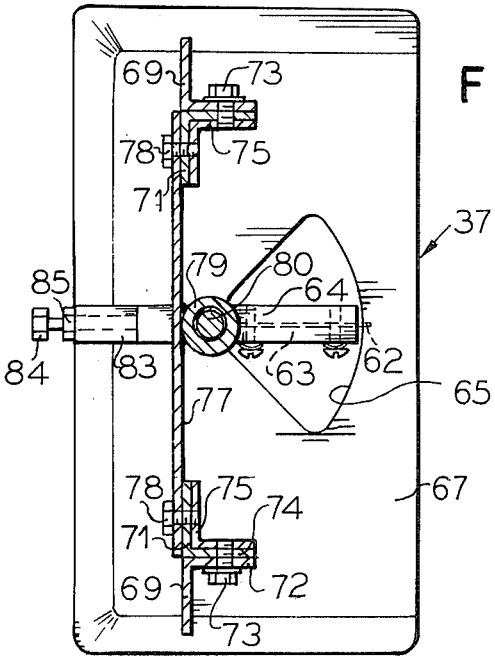
Figure 9:
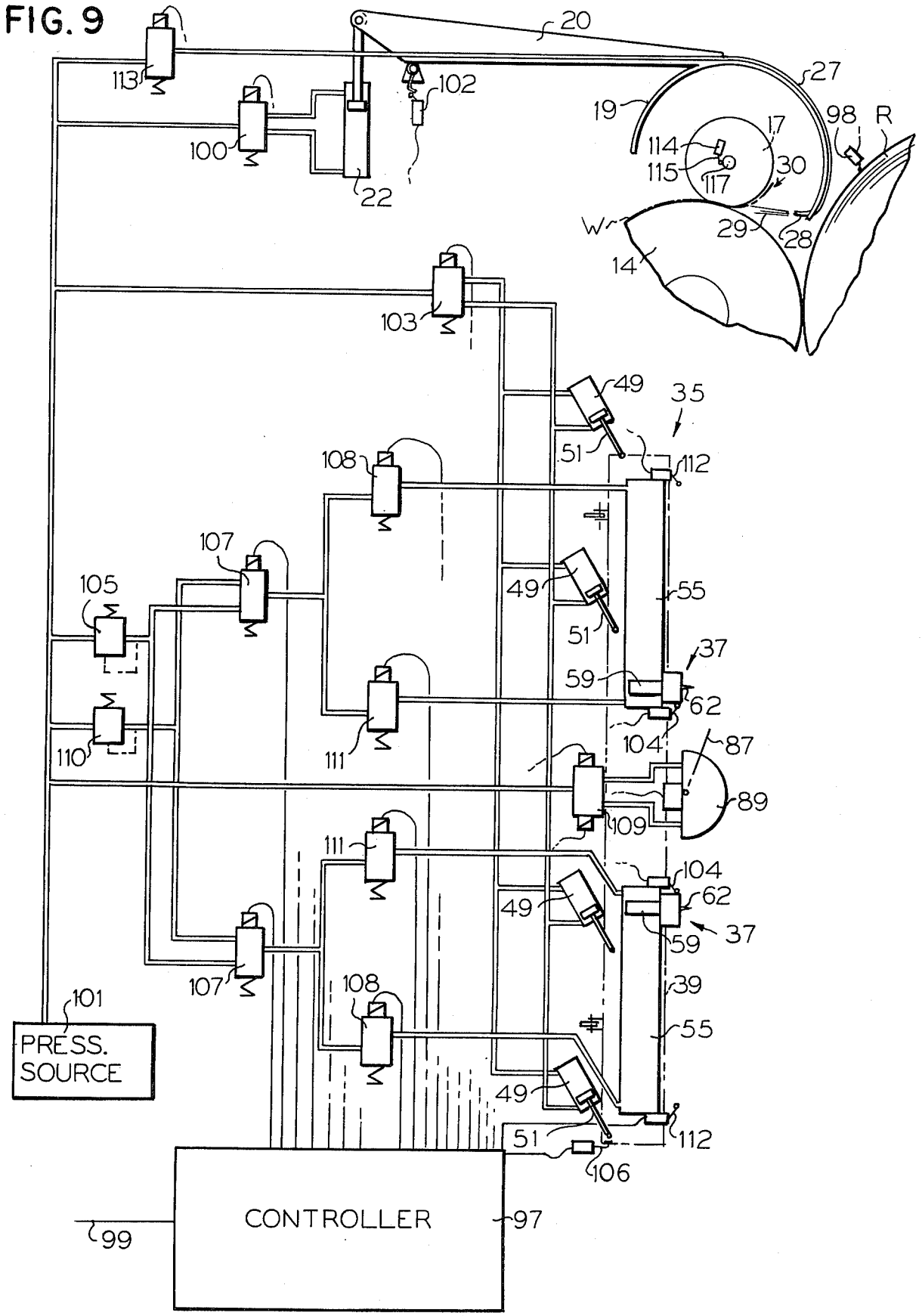

FIGS. 3*a* to 3*e* are fragmentary sectional plan views showing the sequence of steps involved in the method of the present invention as practiced by the disclosed apparatus;

FIG. 4 is an enlarged fragmentary sectional elevational view taken substantially along the line IV—IV of FIG. 2;

FIG. 5 is an enlarged fragmentary elevational view taken substantially in the plane of line V—V of FIG. 4;

FIG. 6 is an enlarged fragmentary elevational view taken substantially along the line VI—VI of FIG. 5;

FIG. 7 is a sectional elevational view taken substantially along the line VII—VII of FIG. 6;

FIG. 8 is a fragmentary elevational view taken substantially in the plane of line VIII—VIII of FIG. 1; and FIG. 9 is a schematic electro-pneumatic operating diagram.

A winder apparatus embodying the present invention, as shown in FIGS. 1 and 2, includes a machine frame 10 comprising spaced uprights 11 supporting therebetween a horizontal beam 12. A web W to be wound, and which may be paper up to 400 inches wide is adapted to travel continuously at high speed which may attain up to 4000 feet per minute between the uprights 11 on a guide roll 13 supported by the machine frame, and then over a winding drum 14 carried rotatably in a suitable manner (not shown) by the machine frame 10 and driven at machine speed as by means of a motor 15. From the winding drum 14, the web W passes into a roll R driven by engagement with the drum 14. The manner in which the roll R is supported and handled may be in accordance with the disclosures in the aforesaid U.S. Pat. Nos. 3,586,253 and 3,857,524 which are to any extent necessary for full understanding incorporated herein by reference. It will be understood that the roll R will be rolled on a reel or core 17. As more particularly disclosed in U.S. Pat. No. 3,586,253, a succession of the cores 17 is adapted to be supplied for winding a succession of the rolls R.

The present invention is directed more particularly to the separation of successive lengths of the continuously running web W from preceeding lengths that have already been wound into successive rolls R, and starting the succeeding lengths onto successive reel cores 17 for winding into rolls.

Each successive reel core 17 is delivered to a transfer arm device 18 which swings each successive fresh core 17 from the delivery device (not shown) into driven running relation to the perimeter of the drum 14. As the reel or spool or core 17 reaches nipping relation to the drum 14, a generally semi-circular web leading end guide member 19 (FIGS. 1 and 8) is lowered into concentric spaced relation to the rotating core. For this purpose, the guide member 19 is carried by the distal end portion of a supporting arm 20 which is pivotally mounted on a bracket 21 supported by the beam 12. Means for actuating the arm 20 swingably comprises a pneumatic cylinder 22 having its proximal end pivotally mounted to a bracket 23 on the beam 12 and having a piston rod 24 pivotally attached to a proximal terminal lever extension 25 on the arm 20. Through this arrangement, the arm 20 is adapted to be swung between the full line and dotted line positions shown in FIG. 1 for moving the arcuate guide member 19 into and out of position relative to the core 17 freshly positioned for winding of the web W thereon.

Carried by the guide member 19 is an air pipe 27 which has a nozzle 28 directed toward the offrunning side of the nip between the drum 14 and the core 17. An air jet 29 directed from the nozzle 28 is adapted to turn up and direct a leading end 30 on the continuously running web W onto the core 17 for starting winding of the web onto the core which at this time will have reached a speed of rotation equal to the speed of rotation of the drum 14 and the speed of travel of the web W. Although at the start the leading end 30 may be the starting terminal end of the web W as it comes from processing apparatus upstream from the winder, after the initial roll R has been rolled to a desired diameter, fresh leading ends 30 will be formed on the continuously running web W.

Forming of fresh leading ends 30 is started at a location upstream from the fresh rotating core 17 after each preceeding roll R has reached a desired diameter. To this end, as best visualized by referring to FIG. 3*a*, the continuously running web W is first slit along a limited machine direction distance as indicated at 31. This defines a leading end starter tongue area 32 for the fresh leading end 30. By preference, the slitting 31 is effected on spaced parallel lines which may be 10 to 20 inches apart and substantially coextensive and of a length to provide a leading end tongue area about two or three times as long as wide. By preference, the tongue area 32 is provided at the longitudinal center of the web W. However, if preferred, the tongue area 32 may be provided along one of the edges of the web W, such as the front edge when viewed as in FIG. 1. In such case, only a single slit 31 will be formed suitably spaced from the web edge.

Upon completion of the desired length of slits 31, slitting of the web is continued as indicated at 33, but in cross-machine direction and away from the tongue area 32 to the web edge to complete separation of the fresh leading end 30 from the length of the web wound on the preceeding roll R. Conveniently, the slitting 33 is effected diagonally from the base or trailing end of the tongue area 32 to the side edge of the web W which is opposed by the side of the tongue area 32 from which the slit extends. Where the tongue area 32 is located in spaced relation to both of the longitudinal edges of the web W, the slitting is effected by respective slits 33 diverging from one another to the respective opposite edges.

Until the starter tongue area 32 reaches and passes through the nip N (FIGS. 3*d* and 3*e*) between the winding drum 14 and the fresh core 17 and is acted upon by jet 29, the tongue area 32 remains attached at its leading extremity to the downstream portion of the web W, so as to continue uninterrupted forward running of the web W both upstream and downstream from the fresh leading end 30. Then after passing through the nip N, the tongue area 32 is detached from the downstream portion of the web, turned up, and directed to wind onto the fresh core 17 by action of the jet 29, thus starting winding of the entire leading end 30 onto the core.

Detachment of the tongue area 32 is facilitated by effecting a preliminary starting, partial separation by means of a slash 34 (FIG. 3*b*) which is desirably formed in the tongue area before the cross machine slitting 33 is effected. The slash 34 affects only a transversely intermediate portion of the tongue area 32 (e.g. the slash 34 may be 6–10 inches long where the tongue area is 10–20 inches wide), leaving unsevered portions (e.g. from 3 to 5 inches wide) of the tongue area at opposite ends of the slash, so that forward drawing of the web W can continue by virtue of the attachment of the leading end of the tongue area 32 to the downstream portion of the web. The length of the slash 34 relative to the width of the tongue area 32 should be such, having regard to the type of paper being wound, that the jet 29 will reach through the slash 34 under the tongue area 32 and rip the remaining attached portions of the tongue area to the slits 31 (FIG. 3*e*). The detached tongue area 32 is then turned up by the jet 29 into winding relation onto the drum 17. The jet 29 continues impinging onto the following portion of the leading end 30 to assure winding thereof on the fresh core 17. Winding of the fresh roll R then proceeds as usual.

For effecting the slitting and slashing to provide the fresh leading end 30, apparatus 35 (FIGS. 1, 2, 4 and 5) has been devised, comprising slitting means 37 and slashing means 38, both supported by an elongate beam 39 extending in cross machine direction upstream from the fresh rotating core 17, and more particularly overlying the span of the web W running between the rotating guide roller 13 and the winding roll 14.

Mounting of the supporting beam 39 is conveniently effected by means of a plurality of suspension brackets 40 attached to and depending from the frame cross beam 12 at suitable spaced intervals. Each of the brackets 40 has fixed on its upper end portion a vertical mounting plate 41 provided with vertically elongate bolt hole 42 through which attachment bolt 43 extends for securing the mounting plate to the face of the beam 12 which is directed generally toward the winding drum 14. The elongate bolt holes 42 permit accurate vertical adjustment of each of the brackets 40, and thereby the apparatus beam 39, as by means of a respective vertically extending adjustment screw 44, the shank of which extends freely through a fixed boss 45 on the frame beam 12 and is threaded into an underlying ear lug 47 rigid with the mounting plate 41. Thus, turning of the head of the adjustment screw 44 lying in thrust bearing relation on the boss 45 permits vertical adjustment with virtually micrometer precision with respect to each of the brackets 40.

Attachment of the lower ends of the brackets 40 to the apparatus beam 39 is by means of respective pivots 48 (FIGS. 1 and 4) in such manner that the beam 39 can be swung up from its edge nearest the brackets 40 into a position substantially backed up against the brackets, i.e., from the fullest line position in FIG. 4 to the dot dash fantom position. Such swinging or shifting of the beam 39 is adapted to be accomplished by means of respective pneumatic cylinders 49 having an end connected by pivot means 50 (FIGS. 1 and 2) to the ear lugs 47 of the brackets and piston rod 51 at the opposite end connected distally by means of a pivot 52 to a respective eye lug 53 fixed on the side of the beam 39 remote from the side adjacent to which the beam is connected to the brackets 40.

For effecting the divergent slitting 33, two of the slitting means 37 are provided and are adapted to be actuated longitudinally along the beam 39 from a position for cutting the tongue side slits 31, as shown in full line in FIG. 2, laterally in opposite directions while cutting the divergent slits 33 and ending in clearance relation to the sides of the web W as indicated in dash outline in FIG. 2. To this end, each of the slitting means 37 comprises an assembly mounted to means such as an elongate head bar 54 (FIGS. 4–6) by which the assembly 37 is adapted by means of a suitable actuator 55 to be not only supported by the apparatus beam 39 but also actuated longitudinally therealong in the operation of the slitting means 37. While the actuator 55 may comprise any preferred expedient such as a motor driven chain or cable, a convenient device for the purpose comprises air cylinder means preferably of the Origa rodless type, there being a separate respective one of such pneumatic cylinder actuators for each of the slitting assemblies 37. Each of the actuators 55 has at each opposite end an end closure 57 which is secured as by means of an attachment flange 58 bolted to the underside of the apparatus beam 39 (FIG. 2). Within each of the cylinders 55 a free-floating piston 59 is connected to the respective head bar 54 by means of a relatively narrow connecting fin 60 extending through a narrow guide slot 61 in the wall of the actuator cylinder 55.

In a desirable construction, each of the slitting assemblies 37 comprises a razor type slitting blade 62 readily replacably secured as by means of a clamping plate 63 (FIGS. 6 and 7) in a holder 64 in a manner to project through a clearance aperture 65 in a web-facing stabilizer shoe plate 67 desirably elongate in cross-machine direction and having its upstream and side margins turned up for smooth sliding engagement with the running web W. For mounting the blade holder 64 and the shoe 67 to the head bar 54, bracket means comprising a head bar strip 68, and downwardly projecting side angle leg members 69 at opposite ends of the head strip, is attached as by means of cap scews 70 to the forward, that is the downstreamwardly facing, elongate face of the head bar 54. Carried fixedly by the shoe 67 is a pair of spaced upwardly projecting angular posts 71 adapted for back-to-back assembly with the depending legs 69. Attachment of the posts 71 to the legs 69 is effected in a manner to permit up and down adjustment of the shoe 67 relative to the head bar 54 for optimum performance of the slitter assembly. For this purpose, the legs 69 are provided with longitudinally extending bolt holes 72 through which the shank of a respective attachment cap screw 73 is projectable to extend through a round bolt hole 74 in the contiguous flange of the post 71, with the screw then retainingly threaded into a tapped nut angle 75.

For mounting the blade holder 64, the posts 71 carry a cross bar 77 attached as by means of cap screws 78 with their shanks extending through end portions of the bar 77 and through the contiguous flanges of the respective posts 71 and threadedly engaging a respective flange of the angular nut 75. Fixed to the forward side of the cross bar 77 is a swivel bushing 79 aligned with the clearance aperture 65 and accommodating a swivel pin 80 fixed on the holder 64. The pin 80 is adapted to be inserted through the bushing 79 from below and is threaded on its upper end portion which projects above the bushing and carries a retaining nut 81. Suitable thrust washers 82 are mounted about the pin 80 at the upper and lower ends of the bushing 79.

As will be observed in FIG. 4, in the operating mode the apparatus 35 is, in effect, tilted upwardly and in downstream direction relative to the path of travel of the web W complementally with respect to the span of the web between the guide roller 13 and the winding roll 14. At the start of the operating mode, the slitting blades 62 should be disposed with their respective planes as nearly as practicable in straight line parallel relation to the longitudinal axis of the travelling web W so as form the starting tongue defining slits 31. On the other hand, for cutting the slits 33, the blades must assume the diagonal, divergent slitting directions for these slits. This is implemented by the swivel mounting of the blade holder 64, and the generally segmentally shaped clearance area of the clearance aperture 65 in the shoe 67 to accommodate oscillation swinging of each of the respective slitting blades 62.

Since each holder 64 is free swivelling, counterbalance means are provided thereon for normally maintaining a straight ahead position of the associated blade 62. Since in operation the slitting assembly 37 is tilted upwardly and forwardly, counterbalancing is easily accomplished by an upstreamly directed counterweight tail 83 on the holder 64. For fine counterbalance adjustment, means comprising a bolt 84 is threaded into the rear end of the counterbalance tail 83 and is adjustably locked by means of a lock nut 85. Through this arrangement, the slitting blade 62 in each instance is normally oriented in a straight-on direction so that at the beginning of the operating mode when the blades 62 are thrust into slitting relation through the travelling web W the slits 31 will be formed straight and substantially parallel, until the slitting assemblies 37 are actuated by the actuators 55 to move in respective traverse directions toward the opposite edges of the travelling web W; thereupon the blades 62 by virtue of the swivel mounting of the holders 64 will automatically assume the angular relation to the slits 31 to continue slitting in the diagonal direction of the slits 33 until the blades leave the respective opposite edges of the web, whereupon the counterbalance means will automatically orient the blades in straight-on direction.

As described in connection with FIG. 3*b*, the slash 34 is desirably formed in the tongue 32 before the slits 33 are formed. The slashing is accomplished by means of the slashing means 38 comprising a thin, preferably flexible slashing whip rod 87 (FIGS. 4 and 5) carried on the forward end of an oscillatable shaft 88 of a reversible pneumatic motor 89 mounted on a bracket 90 secured as by means of attachment flanges 91 and cap screws 92 to the front face of the apparatus beam 39. A guard plate 93 is secured to the bracket 90 and has respective side guard flanges 94 located just outside of the operating sweep range of the slashing rod 87. Since the rod 87 is necessarily operated with a quick whipping action, rubber lined stops 95 are located to stop and absorb the whiplash of the rod 87 at each opposite end of slashing travel thereof. Operation of the slashing rod 87 is effected by firing it alternately from one side to the other side for each slash, that is, for one slash it is whipped from one side toward the opposite side, then stopped until the next slash is required and then whipped back to form the succeeding slash, coordinated with operation of the slitters 37.

Means for controlling sequence of the roll starting system may comprise manually operated devices. However, modern technology, and high production speeds demand as nearly as practicable automatic controls such as an electro-pneumatic control system as schematically illustrated in FIG. 9 wherein the black box 97 represents a controller including all of the customary electrical wiring and gadgetry such as timers, relays, electrical switches, etc. not specifically referred to in the system. When winding the first roll R, the system may be manually controlled to initiate operation of the system. Thereafter, sequential functioning of the system should continue uninterruptedly and automatically for the duration of continuous run of the web from supply source, such as paper making machine.

Automatic controls for the system may include a finished roll diameter sensor such as an electrical eye or switch 98 for transmitting a starting signal to the controller 97 which may through a signal line 99 activate the fresh reel core apparatus including the arm 18 for supplying a fresh core 17 to the winding drum 14. In timed relation to that function, the controller 97 causes a solenoid valve 100 to control air supply to the pneumatic actuator 22 for swinging the guide member arm 20 downwardly for positioning the web guide 19 and air duct 27 over the fresh core 17 now on the winding drum 14. Air under pressure is supplied from a mill sourde 101 through suitable piping or air ducts as shown.

As the arm 20 comes to a stop in its operative position, a sensor such as a switch 102 is actuated to signal the controller 97 that the slitting/slashing phase should start. A solenoid valve 103 is then activated for reversing the apparatus beam controlling actuators 49 from a normal beam raising mode to swing the apparatus beam 39 from the raised inactive position as shown in dot-dash outline in FIG. 4 into the operating position shown in full line. At this time the slitting assemblies 37 are in the proper position at the inner ends of the rodless cylinder actuators 55 and sensing means comprising proximity switches 104 so inform the controller 97. As the beam 39 reaches its lowered, operating position, a sensor, e.g. proximity switch 106, sends a signal to the controller 97, so that low pressure air through a control valve 105, solenoid valves 107 and traverse control solenoid valves 108 continues to be delivered to the outer ends of the actuators 55 to maintain the slitting assemblies 37 in the tongue slitting position for a time interval necessary for cutting the slits 31. Further, in timed sequence a two-way solenoid valve 109 is actuated for operating the cam switch equipped pneumatic motor 89 for stroking the slasher rod 87. Then as the tongue defining slits 31 are completed, the controller 97 permits the solenoid valves 108 to return to disconnect phase, and causes operation of the solenoid valves 107 to effect connection with high pressure valve 110 through solenoid control valves 111 to deliver high pressure air to the inner ends of the actuators 55 for effecting rapid traverse of the slitting devices 37 toward the outer ends of the actuators 55 for cutting the slits 33 in the web. Sensors such as limit switches 112 advise the controller 97 that the slitting devices 37 have traversed beyond the edges of the web whereupon the solenoid valve 103 is reversed and the slitting and slashing apparatus 35 is raised away from the travelling web W.

In the meantime, the controller 97 has caused a solenoid valve 113 to open high pressure air supply to the air pipe 27 for issuing the turn-up jet 29 from the nozzle 28, which turns up the fresh leading end 30 of the web W.

As the apparatus 35 is raised, high pressure air from the valve 110 is discontinued and low pressure air through the valve 105 is resumed to return the slitting devices 37 to starting position.

After the new roll has been wound to a limited diameter on the fresh core 17, a sensor such as a limit switch 114, which may be carried by one of the arms 18 and with a control finger 115 responsive to the position of shaft 117 of the core 17, signals and causes the controller 97 to effect reversal of the actuator 22. This causes raising of the arm 20 to clear the guide 27 and nozzle 28 from the newly forming roll which is then moved to the position of the preceeding completed roll R that has by this time been moved into clearance relation to the winding drum 14. The fresh roll starting system then remains quiescent until the new roll R reaches desired diameter and the sensor 98 initiates another cycle of operation of the system through the controller 97.

It will be understood that variations and modifications may be effected without departing from the spirit and scope of the novel concepts of this invention.

We claim as our invention:

1. In apparatus for winding web running continuously in a machine direction into successive rolls, and including means for starting winding of a respective leading end of the web onto a respective fresh rotating core, driven by a nipping roll to attain web running speed, for each roll:

slitting means located upstream from said fresh rotating core;

means for operating said slitting means, after a preceeding roll has been wound to a desired diameter and is still turning at winding speed, for starting a fresh leading end on the continuously running web by first slitting the web a limited distance in the machine direction for defining an elongate leading starter tongue area attached at its ends to the web and then completing the remainder of the fresh leading end by slitting the web in cross machine direction from said tongue area;

means upstream from the nip of said core and said nipping roll for partially separating the leading end of said tongue area from the web but leaving said leading end of the tongue area still attached to the web until said leading end of the tongue area has passed through said nip;

and said winding starting means being adapted for tearingly completing separation of said partially separated leading end of said tongue area from said web after said partially separated leading end of said tongue area has passed through said nip and for then directing the tongue area and said remainder of said fresh leading end into winding relation onto a fresh rotating core for winding of the web into another roll.

2. Apparatus according to claim 1, including means for moving said slitting means into and out of slitting position relative to the running web.

3. Apparatus according to claim 2, wherein said moving means comprises an apparatus beam supporting said slitting means, said means for operating said slitting means being supported by said apparatus beam, and means for raising and lowering said apparatus beam.

4. Apparatus according to claim 3, including a linear actuator carried by said apparatus beam, and said slitting means being connected to said actuator and adapted to be reciprocated by said actuator between a position on said beam for effecting said machine direction slitting, and a position at the end of said cross machine direction slitting.

5. Apparatus according to claim 3, including means for effecting a preliminary partial leading end separation of said tongue area comprising a device supported by said apparatus beam.

6. Apparatus according to claim 5, wherein said means for effecting preliminary partial leading end separation comprises a slasher, and means for operating said slasher in coordinated relation with said slitting means.

7. Apparatus according to claim 1, including electropneumatic means for controlling and coordinating operation of said slitting means, said operating means, said means for effecting preliminary partial leading end separation and said starting means.

8. Apparatus according to claim 1, wherein said slitting means comprises a slitting blade, a blade holder, swivel means supporting said blade holder, and means supporting said swivel means comprising a web-opposing shoe plate having a clearance opening therein through which said blade projects and which opening is dimensioned to permit a range of oscillating movements of the blade as permitted by swivelling of said holder, said holder having counterbalancing means for normally orienting said holder for straight on machine direction slitting by said blade but permitting swinging of the blade for said cross machine direction slitting.

9. Apparatus according to claim 1, wherein said slitting means comprises a pair of slitting blade devices and means mounting the same for normally cutting a pair of machine direction slits in the web for defining said leading starter tongue area, and said operating means being operative for effecting transverse of said devices in opposite cross-machine directions from said tongue area for completing the remainder of said fresh leading end.

10. For use in apparatus for winding web running continuously in a machine direction into successive rolls, and including means for starting winding of a respective leading end of the web onto a respective fresh rotating core for each roll, slitting means adapted to be located upstream from said fresh rotating core and comprising:

a slitting blade;

a blade holder;

swivel mounting means for said holder permitting swinging of the holder for orienting the blade between machine direction slitting of the web and cross machine direction slitting of the web;

means supporting said swivel mounting means and adapted for connection to means for operating the slitting means;

and a web-opposing shoe comprising a plate member having an aperture therein through which said blade projects.

11. Slitting means according to claim 10, including counterbalancing means normally orienting said holder for machine direction slitting by said blade.

12. For use in apparatus for winding web running continuously in a machine direction into successive rolls, and including means for starting winding of a respective leading end of the web onto a respective fresh rotating core for each roll, slitting means adapted to be located upstream from said fresh rotating core and comprising:

a slitting blade;

a blade holder;

swivel mounting means for said holder permitting swinging of the holder for orienting the blade between machine direction slitting of the web and cross machine direction slitting of the web;

means supporting said swivel mounting means and adapted for connection to means for operating the slitting means;

and counterbalancing means normally orienting said holder for machine direction slitting by said blade.

13. A method of winding into successive rolls a web running continuously in a machine direction, and including, for each roll, starting winding of a respective leading end of the web onto a respective fresh rotating core by driving a nipping roll in engagement with said core and by which web running speed of the core is attained, comprising:

at a location upstream from the fresh rotating core, and after a preceeding roll has reached a desired diameter and is still turning at winding speed, starting a fresh leading end on the web including first slitting the continuously running web along a limited machine direction distance and thereby defining an elongate leading end starter tongue area for the fresh leading end and still attached at its downstream end to the web;

upstream from the nip of said core and said nipping roll partially separating the leading end of said tongue area from the web and leaving said leading end of the tongue area still attached to said web until said leading end of the tongue area has passed through said nip;

then continuing slitting of the web but in cross machine direction and away from said tongue area to the web edge to complete separation of said fresh leading end from the length of the web wound on the preceeding roll;

downstream from said nip effecting tearing separation of said leading end of the tongue area from the web;

and then directing said tongue area and the remainder of said fresh leading end of the web into winding relation onto the fresh rotating core for winding of the web into another roll.

14. A method according to claim 13, comprising effecting said partial separation by slashing across said tongue area to facilitate said subsequent tearing separation the leading end of the tongue area from the web.

15. A method according to claim 13, comprising effecting said slitting by operation of slitting means, and moving said slitting means into and out of slitting relation to the web in timed relation to winding of each roll.

16. A method according to claim 13, comprising effecting said separation and directing by driving an air jet toward and against said leading end of the web including said tongue area.

17. A method according to claim 13, comprising effecting said slitting mechanically and effecting said separation and directing pneumatically.

* * * * *